252-99 AU 166 EX
5/16/78 XR 4,089,795

United States Patent [19]
Bailey et al.
[11] 4,089,795
[45] May 16, 1978

[54] ORTHOPHOSPHATE AND SILICA-CONTAINING COMPOSITION

[75] Inventors: John Bailey, Crawcrook; Michael John Randell; Paul Richard Sherrington, both of Newcastle-upon-Tyne, all of England

[73] Assignee: The Procter & Gamble Company, Cincinnati, Ohio

[21] Appl. No.: 657,527

[22] Filed: Feb. 12, 1976

[30] Foreign Application Priority Data

Feb. 14, 1975 United Kingdom ..... 6359/75

[51] Int. Cl.² ..... C11D 3/06; C11D 7/16
[52] U.S. Cl. ..... 252/135; 252/99; 252/DIG. 15; 252/140

[58] Field of Search ..... 252/135, 140, 99, DIG. 15

[56] References Cited

U.S. PATENT DOCUMENTS

| | | | |
|---|---|---|---|
| 3,630,922 | 12/1971 | McClaim | 252/99 |
| 3,630,929 | 12/1971 | van Dijk | 252/135 |
| 3,736,259 | 5/1973 | Buck | 252/140 |

*Primary Examiner*—Mayer Weinblatt
*Attorney, Agent, or Firm*—Robert B. Aylor; Richard C. Witte; Thomas H. O'Flaherty

[57] ABSTRACT

The present invention relates to detergent additive and detergent compositions containing an alkali metal ortho phosphate and silicas which are particularly effective in cleaning ability, whiteness maintenance, and in controlling water hardness.

16 Claims, No Drawings

ORTHOPHOSPHATE AND SILICA-CONTAINING COMPOSITION

BACKGROUND OF THE INVENTION

The present invention relates to detergent additives and detergent compositions. A detergent additive is a product designed to supplement the consumer's ordinary detergent product to boost the latter's effectiveness. The detergent composition aspect of the present invention encompasses the detergent additive aspect with the additional feature of having present a surface active agent in the composition.

Alkali metal orthophosphates function as detergent builders by precipitating calcium ions on a 2 to 3 mole basis respectively. The orthophosphates of the present invention are not as effective in building capacity as the pyrophosphates discussed below and in the concurrently filed U.S. patent application Ser. No. 550,054 for Cherney and Hau (attorney's Docket Number 2174) herein incorporated by reference. However, soluble ortho phosphates provide a distinct advantage in the present invention of providing whiteness maintenance. The distinction between whiteness maintenance and building capacity is that in the former, the tendency of washed fabrics to pick up suspended soils from the wash solution over a number of wash cycles is measured by the reflectance of light. Builder effectiveness is measured by the ability of the orthophosphate or other builder material to control hardness so that soiled fabrics may be cleaned in the first instance. Builder effectiveness is also measured by light reflectance on the fabrics that are washed and dried. The importance of builder effectiveness and whiteness maintenance may be demonstrated by washing a heavily siled white towel with a lightly soiled towel. When both towels are cleaned in a wash cycle the wash water is drained through the towels prior to the rinse step causing the suspended soils from the heavily soiled towel to be deposited on the lightly soiled towel. Often the suspended soils are harder to remove from the fabrics than to remove the soil from the fabric initially. Over a number of cycles the suspended soil building up causes white articles particularly terry cloth to gray or become dingy.

Those skilled in the detergency arts have also for many years equated the alkali metal pyrophosphates with the alkali metal tripolyphosphates in detergent compositions. It is known that pyrophosphates and tripolyphosphates when used as builders will each sequester one mole of calcium or magnesium water hardness per mole of the phosphate species. Pyrophosphate detergency builders, however, unlike tripolyphosphates will under certain conditions form minor amounts of dicalcium pyrophosphate a completely neutralized insoluble salt. The precipitation of the pyrophosphates discussed above may take place on the fabrics being cleansed or upon the surfaces of the washing machine. Such buildup of the calcium pyrophosphate salt is undesirable in that the precipitates have a tendency to remain on the fabrics through several wash cycles and continue to buildup thus causing harsh fabric. Similarly, the calcium pyrophosphate will after several cycles in a washing machine cause unsightly deposition or scale on the exposed surfaces. This precipitation phenomenon of the pyrophosphates has led many detergent manufacturers to avoid pyrophosphates and to instead use tripolyphosphates.

It has been suggested in U.S. Pat. No. 2,381,960 to Johnson issued Aug. 14, 1945 that the effectiveness of sodium pyrophosphate in reducing water hardness could be obtained by adding the pyrophosphate to the solution of hard water after an alkaline material had been first added to the water. The alkaline materials taught by Johnson were sodium orthophosphate, sodium and potassium hydroxide, sodium and potassium carbonates, and sesquicarbonates, soap and sodium silicate having an $SiO_2$:$Na_2O$ weight ratio greater than 1.5. The point of addition of the tetrasodium pyrophosphate to the solution is stated to be prior to the formation of a macroscopic precipitate of the hardness ions and the aforementioned alkaline materials.

In U.S. Pat. No. 2,326,950 issued Aug. 17, 1943 to Kepfer, it is taught that tetrasodium pyrophosphate is used more efficiently to control water hardness when it is used in conjunction with an alkaline material which is added to the solution before a macroscopic precipitate of the hardness ions and the pyrophosphate is formed. The alkaline materials taught by Kepfer are sodium borate, sodium metasilicate ($SiO_2$:$Na_2O$ 1:1) and disodium hydrogen phosphate. The processes of controlling water hardness by somehow increasing the effectiveness of sodium pyrophosphate taught Kepfer and Johnson, herein incorporated by reference, suffer from the defect that the composition could not be effectively prepared without going to the trouble of positively insuring the delay of the pyrophosphate relative to the alkaline materials or vice versa. Thus Kepfer and Johnson could only with great difficulty be adapted for use in granular or liquid products which are favored by the consumer today.

U.S. Pat. 3,708,428 issued Jan. 2, 1973, to McDonald discusses the neutralizing of organic detergent acids such as alkyl benzene sulfonic acid with sodium silicates having an $SiO_2$:$Na_2O$ ratio of from about 1:2 to about 1:4 to form an in situ silica having an $SiO_2$:$Na_2O$ ratio of from about 1:4 to about 1:2000 or greater. An essential condition to the compositions taught in McDonald is that the inclusion of water soluble alkali builders, illustrated by sodium or potassium orthophosphates, or complex phosphates (i.e. pyrophosphates), alkali carbonates, borates, silicates, or neutral salts, such as sodium chloride or sodium sulfate, or magnesium sulfate, be restricted to levels of concentration of the order of 4% by weight or lower. McDonald goes on to state the desired advantages of the in situ formed colloidal silicas on the removal of soils will be found to be appreciably impaired if the foregoing limits ae not strictly adhered to.

It is thus an object of the present invention to utilize an alkali metal orthophosphate more efficiently in the control of water hardness and whiteness maintenance.

It is a further object of the present invention to prepare a composition utilizing an alkali metal orthophosphate as a detergency builder that minimizes the buildup on fabrics of water insoluble orthophosphates.

It is yet a further object of the present invention to provide a detergent additive product or a complete detergent composition built with an alkali metal orthophosphate which is particularly effective in cleaning and whiteness maintenance.

It has now been found that by preparing a detergent additive comprising an alkali metal orthophosphate and silica or a complete detergent composition comprising the alkali metal orthophosphate, silica and an organic detergent component that the objects of the invention may be achieved.

Moreover, the use of the alkali metal orthophosphate with the silica of the present invention in an additive or detergent composition substantially decreases the amount of calcium ion in the wash solution. While not wishing to be bound by any particular theory it is the applicants' belief that silica in some manner encourages the precipitation of calcium ions in the wash solution as insoluble calcium orthophosphates.

Particularly effective compositions of the present invention are prepared by using both soluble orthophosphates and pyrophosphates such that both phosphates precipitate water hardness in conjunction with the silica. These mixtures of pyrophosphates and orthophosphates must be in a respective weight ratio of 1.5:1 to about 1:4, preferably about 1.5:1 to about 1:2.5, most preferably about 1.5:1 to about 1:1.5. The ratio 1.5:1 above is important in that undersirable fabric feel occurs at higher ratios. Thus, where prior art compositions pyrophosphate salts were only able to effectively sequester on a 1:1 mole basis with calcium hardness, the present invention allows the pyrophosphate to effectively control twice the amount of calcium which is possible by sequestration. The precipitation of the dicalcium pyrophosphate takes place with the aid of the silica such that the precipitated salt does not form an unsightly scum on the exposed surfaces of the washing machine or deposit on fabrics to cause a harsh feel. The more effective control of calcium ion in the wash solution means that the detergent components are not as likely to be interfered with by the water hardness in the wash thus providing better cleaning of the fabrics.

Soluble silicates are often added to detergent or additive products to protect exposed machine surfaces from corrosion. It has been found, however, that soluble silicates interfere with the precipitation of calcium hardness as dicalcium pyrophosphate and as the calcium orthophosphates. Other components found in detergent products have also been found to interfere with calcium precipitation as the ortho and pyrophosphate salts, namely the detergent active.

It has now been found that the addition of silicas to the additive or detergent product diminishes the tendency of soluble silicates and other components such as the detergent to interfere with the precipitation of calcium ortho and pyrophosphate.

Throughout the specification and claims percentages and ratios are by weight and temperatures are in degrees Fahrenheit unless otherwise indicated.

SUMMARY OF THE INVENTION

A detergent additive is prepared by this invention comprising:

(a) an alkali metal orthophosphate; and (b) silica having a mean particle diameter less than 20 microns; in a weight ratio of the alkali metal orthophosphate to the silica of from about 25:1 to about 1:2.

A detergent composition is prepared by this invention comprising (a) from about 5% to about 60% by weight of an alkali metal orthophosphate;

(b) from about 1% to about 40% by weight of silica having a mean particle diameter less than 20 microns; and (c) an organic detergent at from about 1% to about 50% by weight of the composition.

DETAILED DESCRIPTION OF THE INVENTION

The present invention has two aspects. The first aspect is a detergent additive product and the second is a complete detergent composition. The detergent additive products are formulated such that they may be used compatibly with other commercially available detergent products. The detergent additives ordinarily do not have organic detergents within their composition. The detergent additive product is intended for use as a presoak product wherein the clothes to be washed are placed in a wash tub or the washing machine and allowed to soak in water containing the additive product for a period of time before the consumer's regular detergent product is added. Alternatively, a detergent additive product may be added simultaneously to the wash solution with the consumer's regular detergent product. In either event the detergent additive product of the present invention boosts the cleaning of the consumer's regular detergent.

When formulated as a detergent composition the present invention is utilized for cleaning in the conventional manner.

The detergent additive or detergent composition of the present invention may be formulated to be in a solid or liquid form. When formulated as a solid the compositions of the present invention may be formed into a single granule such as by spray drying or the components may be separately admixed with one another in any order.

The alkali metal orthophosphates and pyrophosphates of the present invention are commercially available from several sources. The alkali metal orthophosphates and pyrophosphates such as the sodium or potassium salt, preferably the sodium salt may be hydrated or anhydrous.

The silica component of the present invention is also widely available from commercial sources such as those products marketed under the trade name Zeosil sold by the Philadelphia Quartz Company and Ludox marketed by E. I. duPont de Nemours & Company. The silicas useful in the present invention have a mean particle diameter of less than 20 microns, such as from about $1 \times 10^{-4}$ to about 5 microns, preferably from about $5 \times 10^{-4}$ to about 0.1 micron, most preferably from about $1 \times 10^{-4}$ to about 0.05 micron. The surface area is given as an aggregate per unit of weight of the silica. As the surface area of the silica increases the performance advantage of the compositions of the invention increases. The specific surface area in square meters per gram of the silicas of the present invention are preferably greater than 0.2 square meter per gram, preferably greater than 1 square meter per gram, and more preferably greater than 40 square meters per gram, and most preferably greater than 200 square meters per gram.

The mean particle diameter of the silica is defined as being the length of the largest axis of the particle. The surface area is related indirectly to the mean particle diameter of the silica. That is to say that if the geometry of the silica particle is known the theoretical surface area can be calculated from the mean particle diameter. The actual calculation of the surface area will ordinarily be larger than the theoretical surface area as some of the surface area is located within the silica particle. The discrepancy in calculating the surface area arises from the fact that the surface area measurements are ordinarily done by gas or liquid adsorption such as BET or by dyes. The gas or liquid adsorbs on the outer surface of a given silica particle and also on any interior surface which the gas or liquid molecules can reach in the silica particle. Thus as gases present smaller molecules than liquids, the surface area determined by gases will be higher generally than that given by dye adsorption.

A variation of measuring the surface area of the silica is described in U.S. Pat. 3,032,401 to Turner, issued May 1, 1962, herein incorporated by reference.

It is noted that high surface areas of the silica are possible even when a small number of particles are present per given weight of the silica. The foregoing arises where the silica particles are joined "end to end" rather than layered on atop another such that the surface area is diminished. High surface area silicas also are possible when the silica is porous. While high surface area for the silicas of the present invention is necessary it is preferred that the high surface area be accompanied by a large number of particles for thorough distribution in wash or soak solution. Silica particles of the size described above give both high surface area and a large number of particles per unit weight.

The silicas of the present invention to a limited extent can be thought of as being ionic in that some of the hydrogen atoms in the silianol group (-SiOH) of the silica molecule are displaced by cations particularly sodium or potassium.

In the McDonald patent, previously incorporated by reference, the distinction was made that silicas must have an $SiO_2$:$Na_2O$ ratio greater than 4:1 and up to 2000:1. The foreoing definition is applicable here in that no more than one silianol hydrogen per four silicone atoms in the silica molecule should be displaced by a metal cation. Otherwise stated the ratio of $SiO_2$:$Na_2O$ is greater than 4:1. Preferably the degree of replacement of the silianol hydrogen by the cation should be less than 1 in 10 per atom of silicone and preferably less than 1 in 20 per atom of silicone, and most preferably less than 1 in 45 per atom of silicone.

In the additive product the ratio of alkali metal orthophosphate and the pyrophosphate, if the latter is present, to the silica is from about 25:1 to about 1:2, preferably about 20:1 to about 1:1, and most preferably about 15:1 to about 5:1 by weight. The foregoing ratios are also satisfactory in the detergent product.

The present invention contains as an optional ingredient alkali metal silicates of the formula $SiO_2$:$M_2O$, wherein M is an alkali metal preferably sodium or potassium or the foregoing weight ratio is from about 1.6:1 to about 4:1, preferably from about 2.0:1 to about 3.8:1, and most preferably about 2.4:1 to about 3.5:1. While it has been found that the present invention functions as a detergent additive or complete detergent composition satisfactorily and indeed to some benefit for hardness control and cleaning in the absence of silicates it has been found desirable to include in the composition soluble silicates at a level of from about 1% to bout 25%, preferably about 3% to about 20%, and most preferably about 5% to bout 15% by weight. The function of the silicate is important in that it lessens the tendency of the detergent and other components in detergent products to damage the exposed surfaces of the washing machine. The soluble silicates are also desirable in detergent additive type products to complete detergent compositions which are spray dried in that more desirable granule characteristics are obtained by the inclusion of the insoluble silicates at the levels previously given.

The ratio of the silica to the silicate in the present invention is generally in the range of about 10:1 to about 1:10, preferably about 6:1 to about 1:6, and most preferably from about 2:1 to about 1:2 by weight.

When formulated as a complete detergent composition the present invention encompasses all manner of organic detergent components. Suitable detergents include for example the following:

DETERGENT COMPONENT

Preferably the detergent component of the present invention is a water-soluble salt of: an ethoxylated sulfated alcohol with an average degree of ethoxylation of about 1 to 4 and an alkyl chain length of about 14 to 16; tallow ethoxy sulfate; tallow alcohol sulfates; an alkyl benzene sulfonate with an average alkyl chain length between 11 and 13, preferably 11.2 carbon atoms; a $C_6$–$C_{20}$ α-sulfocarboxylic acid or ester thereof having 1 to 14 carbon atoms in the alcohol radical; a $C_8$–$C_{24}$ paraffin sulfonate; a $C_{10}$–$C_{24}$ α-olefin sulfonate or mixtures thereof; or other anionic sulfur-containing surfactant. Such preferred detergents are discussed below.

An especially preferred alkyl ether sulfate detergent component of the present invention is a mixture of alkyl ether sulfates, said mixture having an average (arithmetic mean) carbon chain length within the range of about 12 to 16 carbon atoms, preferably from about 14 to 15 carbon atoms, and an average (arithmetic mean) degree of ethoxylation of from about 1 to 4 moles of ethylene oxide, preferably from about 2 to 3 moles of ethylene oxide.

Specifically, such preferred mixtures comprise from about 0 to 10% by weight of mixture of $C_{12-13}$ compounds, from about 50 to 100% by weight of mixture of $C_{14-15}$ compounds, and from about 0 to 45% by weight of mixture of $C_{16-17}$ compounds, and from about 0 to 10% by weight of a mixture of $C_{18-19}$ compounds. Further, such preferred alkyl ether sulfate mixtures comprise from about 0 to 30% by weight of mixture of compounds having a degree of ethoxylation of 0, from about 45 to 95% by weight of mixture of compounds having a degree of ethoxylation from 1 to 4, from about 5 to 25% by weight of mixture of compounds having a degree of ethoxylation from 5 to 8, and from about 0 to 15% by weight of mixture of compounds having a degree of ethoxylation greater than 8. The sulfated condensation products of ethoxylated alcohols of 8 to 24 alkyl carbons and with from 1 to 30, preferably 1 to 4 moles of ethylene oxide may be used in place of the preferred alkyl ether sulfates discussed above.

Another class of detergents which may be used in the present invention includes the water-soluble salts, particularly the alkali metal, ammonium, and alkylolammonium salts of organic sulfuric reaction products having in their molecular structure an alkyl group containing from about 8 to about 22 carbon atoms and a sulfuric acid ester group. Examples of this group of synthetic detergents are the sodium and potassium alkyl sulfates, especially those obtained by sulfating the higher alcohols ($C_8$–$C_{18}$ carbon atoms) produced by reducing the glycerides of tallow or coconut oil.

Preferred water-soluble organic detergent compounds herein include alkyl benzene sulfonates (preferably essentially linear although "hard" ABS may be used) containing from about 9 to 15 carbon atoms in the alkyl group. Examples of the above are sodium and potassium alkyl benzene sulfonates in which the alkyl group contains from about 11 to about 13 carbon atoms, in straight chain or branched chain configuration, e.g., those of the type described in U.S. Pat. Nos. 2,220,099 and 2,477,383. Especially valuable are straight chain alkyl benzene sulfonates in which the average of the alkyl groups is about 11.2 carbon atoms, abbreviated as $C_{11.2}$LAS.

Another useful detergent compound herein includes the water-soluble salts of esters of α-sulfonated fatty acids containing from about 6 to 20 carbon atoms in the fatty acid group and their esters from about 1 to 14 carbon atoms in the alcohol radical.

Preferred "olefin sulfonate" detergent mixtures utilizable herein comprise olefin sulfonates containing from about 10 to about 24 carbon atoms. Such materials can be produced by sulfonation of α-olefins by means of uncomplexed sulfur trioxide followed by neutralization under conditions such that any sultones present are hydrolyzed to the corresponding hydroxy-alkane sulfonates. The α-olefin starting materials preferably have from 14 to 16 carbon atoms. Said preferred α-olefin sulfonates are described in U.S. Pat. No. 3,332,880, incorporated herein by reference.

The paraffin sulfonates embraced in the present invention are essentially linear and contain from 8 to 24 carbon atoms, preferably 12 to 20 and more preferably 14 to 18 carbon atoms in the alkyl radical.

Other anionic detergent compounds herein include the sodium alkyl glyceryl ether sulfates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Water-soluble salts of the higher fatty acids, i.e. "soaps", are useful as the detergent component of the composition herein. This class of detergents includes ordinary alkali metal soaps such as the sodium, potassium, ammonium and alkylolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e. sodium or potassium tallow and coconut soap.

Water-soluble nonionic synthetic detergents are also useful as the detergent component of the instant composition. Such nonionic detergent materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

For example, a well-known class of nonionic synthetic detergents is made available on the market under the trade name "Pluronic" sold by Wyandotte Chemicals. These compounds are formed by condensing ethylene oxide with a hydrophobic base formed by the condensation of propylene oxide with propylene glycol. Other suitable nonionic synthetic detergents include the polyethylene oxide condensates of alkyl phenols, e.g. the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol.

The water-soluble condensation products of aliphatic alcohols having from 8 to 22 carbon atoms, in either straight chain or branched configuration, with ethylene oxide, e.g. a coconut alcohol-ethylene oxide condensate having from 5 to 30 moles of ethylene oxide per mole of coconut alcohol, the coconut alcohol fraction having from 10 to 14 carbon atoms, are also useful nonionic detergents herein.

Semi-polar nonionic detergents include water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxide detergents containing one alkyl moiety of about 10 to 28 carbon atoms and 2 moieties selected from the group consisting of alkyl groups and hydroxyalkyl groups containing from about 1 to 3 carbon atoms; and water-soluble sulfoxide detergents containing one alkyl moiety of from about 10 to 28 carbon atoms and a moiety selected from the group consisting of alkyl and hydroxyalkyl moieties of from 1 to 3 carbon atoms.

Ampholytic detergents include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic detergents include derivatives of aliphatic quaternary ammonium, phosphonium and sulfonium compounds in which the aliphatic moieties can be straight chain or branched, and wherein one of the aliphatic substituents contains from about 8 to 18 carbon atoms and one contains an anionic water-solubilizing group.

Other useful detergents include water-soluble salts of 2-acyloxy-alkane-1-sulfonic acids containing from about 2 to 9 carbon atoms in the acyl group and from about 9 to about 23 carbon atoms in the alkane moiety; β-alkyloxy alkane sulfonates containing from about 1 to 3 carbon atoms in the alkyl group and from about 8 to 20 carbon atoms in the alkane moiety; alkyl dimethyl amine oxides wherein the alkyl group contains from about 11 to 16 carbon atoms; alkyldimethyl-ammonio-propane-sulfonates and alkyl-dimethyl-ammonio-hydroxy-propane-sufonates wherein the alkyl group in both types contains from about 14 to 18 carbon atoms; soaps as hereinabove defined; the condensation product of tallow fatty alcohol with about 11 moles of ethylene oxide; the condensation product of a $C_{13}$ (avg.) secondary alcohol with 9 moles of ethylene oxide; and alkyl glyceral ether sulfates with from 10 to 18 carbon atoms in the alkyl radical.

A typical listing of the classes and species of detergent compounds useful herein appear in U.S. Pat. No. 3,852,211, to Ohren issued Dec. 3, 1974, incorporated herein by reference. The foregoing list of detergent compounds and mixtures which can be used in the instant compositions is representative of such materials, but is not intended to be limiting.

A particularly useful anionic detergent mixture comprises:

(i) from about 2% to about 15% by weight of an alkyl sulfate wherein the alkyl radical has from 10 to 20 carbon atoms and mixtures thereof the cation being an alkali metal preferably sodium;

(ii) from about 2% to about 15% by weight of an alkyl benzene sulfonate having from 9 to 15 carbon atoms in the alkyl radical and mixtures thereof the cation being an alkali metal preferably sodium.

An additional component which may be added to (i) and (ii) above is:

(iii) from about 2% to about 15% by weight of an alkyl ethoxy sulfate having from 10 to 20 carbon atoms in the alkyl radical and from 1 to 30 ethoxy groups and mixtures thereof having an alkali metal preferably sodium cation.

When formulating the detergent composition of the present invention the organic detergent component is present at from about 1% to about 50%, preferably from about 5% to about 40%, and most preferably from about 12% to about 30% by weight. The ratio of the detergent to builder in the composition is preferably in the range of from about 10:1. to about 1:10, more preferably from about 3:1 to about 1:3.

The amount of alkali metal orthophosphate in the detergent composition is from about 5% to about 60%, preferably about 8% to about 40%, most preferably about 15% to about 35% by weight. The amount of silica in the detergent product is from about 1% to about 40%, preferably about 3% to about 30%, and most preferably about 5% to about 20% by weight.

The colloidal silicas of the present invention are discussed in Dupont Ludox® technical product information A-65503 5M 7/69, Dupont Product Data Sheet Ludox® colloidal silica A-31957, Dupont Ludox® AM Product Information Bulletin A-21163 all of which are incorporated by reference. Further information on silica preparation is found in U.S. Pat. No. 3,437,441, issued Apr. 8, 1969 to Mayes et al and U.S. Pat. No. 3,662,059 to Weisner et al, issued May 9, 1972, incorporated herein by reference.

Soluble silicates are generally discussed in Dupont Product Information Bulletin A-18208, copyright 1961, incorporated by reference.

OPTIONAL INGREDIENTS

The products of the present invention as either a detergent additive or complete detergent composition may contain all manner of ingredients normally found in detergent products such as enzymes, bleaches, stabilizers, dyes, hydrotropes, anti-caking agents, and perfumes.

Soil suspending agents at about 0.1% to 10% by weight such as water-soluble salts of carboxymethylcellulose, carboxyhydroxymethylcellulose and preferably polyethylene glycols having a molecular weight of about 400 to 10,000 are common components of the detergent compositions of the present invention. Dyes, pigments, optical brighteners, and perfumes can be added in varying amounts as desired.

Other materials such as fluorescers, antiseptics, germicides, enzymes in minor amounts, anti-caking agents such as sodium sulfosuccinate, and sodium benzoate may also be added.

Additional amounts of water-soluble detergency builders may be added to the detergent compositions of the present invention. Such inorganic detergency builder salts include alkali metal carbonates, borates, bicarbonates, and sulfates. Specific examples of such salts are the sodium and potassium borates, perborates, bicarbonates, and carbonates.

Examples of suitable organic detergency builder salts are: (1) water-soluble aminopolycarboxylates, e.g. sodium and potassium ethylenediaminetetraacetates, nitrilotriacetates and N-(2-hydroxyethyl)-nitrilodiacetates; (2) water-soluble salts of phytic acid, e.g. sodium and potassium phytates — see U.S. Pat. No. 2,739,942; (3) water-soluble polyphosphonates, including specifically, sodium, potassium and lithium salts of ethane-1-hydroxy-1,1-diphosphonic acid, sodium, potassium and lithium salts of methylene diphosphonic acid, sodium, potassium and lithium salts of ethylene diphosphonic acid, and sodium, potassium and lithium salts of ethane-1,1,2-triphosphonic acid. Other examples include the alkali metal salts of ethane-2-carboxy-1,1-diphosphonic acid, hydroxymethanediphosphonic acid, carbonyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; and (4) water-soluble salts of polycarboxylate polymers and copolymers as described in U.S. Pat. 3,308,067.

A useful detergent builder which may be employed in the present invention comprises a water-soluble salt of a polymeric aliphatic polycarboxylic acid having the following structural relationships as to the position of the carboxylate groups and possessing the following prescribed physical characteristics: (a) a minimum molecular weight of about 350 calculated as to the acid form; (b) an equivalent weight of about 50 to about 80 calculated as to acid form; (c) at least 45 mole percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of the above-described builders include polymers of itaconic acid, aconitic acid, maleic acid, mesaconic acid, fumaric acid, methylene malonic acid and citraconic acid and copolymers with themselves.

In addition, other builders which can be used satisfactorily include water-soluble salts of mellitic acid, citric acid, pyromellitic acid, benzene pentacarboxylic acid, oxydiacetic acid, carboxymethyloxysuccinic acid, and oxydisuccinic acid.

The detergent compositions of this invention preferably contain the water-soluble detergent in a ratio to the total builder present in a weight ratio of from about 10:1 to about 1:10, preferably from about 3:1 to about 1:3. The amount of additional builder in the detergent compositions of the present invention is from about 5% to about 50%, preferably from about 10% to about 25%. These additional builders may be dried with the aqueous slurry or admixed with the dried product of the slurry.

Certain zeolites or alumino silicates when dried with the components of the slurry enhance the function of the silicate of the slurry and add building capacity in that the alumino silicates sequester calcium hardness. When admixed with the dried product of the slurry the alumino silicates function as a cobuilder to the pyrophosphates. One such alumino silicate which is useful in the compositions of the invention is an amorphous water-insoluble hydrated compound of the formula $Na_x(xAlO_2.ySiO_2)$, wherein $x$ is an integer of from 1 to 1.2 and $y$ is 1, said amorphous material being further characterized by a $Mg^{++}$ exchange capacity of from about 50 mg eq. $CaCO_3$/g to about 150 mg eq. $CaCO_3$/g. This ion exchange builder is more fully described in Ireland published patent application 1505/74 to B. H. Gedge et al. filed July 16, 1974, herein incorporated by reference.

A second water-insoluble synthetic aluminosilicate ion exchange material useful herein has the formula $Na_z[(AlO_2)_z.(SiO_2)_y]xH_2O$, wherein $z$ and $y$ are integers of at least 6; the molar ratio of $z$ to $y$ is in the range from 1.0 to about 0.5, and $x$ is an integer from about 15 to about 264; said aluminosilicate ion exchange material having a particle size diameter from about 0.1 micron to about 100 microns; a calcium ion exchange capacity of at least about 200 mg eq./g; and a calcium ion exchange rate of at least about 2 grains/gallon/minute/gram.

These detergent builders are discussed in Belgian Patent 814,874 herein incorporated by reference.

The above described aluminosilicates are employed at levels of from about 1% to about 40%, preferably about 5% to about 25% by weight.

When the compositions of the present invention are to be prepared in a liquid nondetergent form solvent such as water and alcohols having from 1 to 8 carbon atoms may be used at the liquid medium. The alcohols useful herein may be branched or straight chained, monohydric or polyhydric. Preferred alcohols for use in forming liquid detergent or additive compositions of the present invention include ethanol, glycerine and ethylene glycol. The solvents may be used alone or as mixtures at levels of from about 10 to about 90%, preferably about 15% to about 70%, and most preferably about 20% to about 50% by weight of the composition.

The precipitation of calcium orthophosphate and the pyrophosphate if present can be enhanced in the additive or detergent compositions by including a source of alkalinity such as, preferably the alkali metal carbonates, and also the alkali metal and alkaline earth metal hydroxides at levels of from about 2% to about 30%, preferably from about 5% to 20% by weight.

COMPOSITION PREPARATION

The detergent additive or complete detergent product of the present invention may be formulated into liquid semi-solid or solid, preferably granular states.

To prepare liquid compositions of the detergent additive or complete detergent product, the individual components are prepared in the slurry or solution within the previously discussed weight limitations. To facilitate mixing the slurry or solution of the components may be heated slightly, preferably not above the flash point of any organic solvent used in the solution.

The silicas of the present invention being colloidal in nature tend to support or prevent settling out of the less soluble components in the slurry or solution. The foregoing property of the silica is particularly advantageous when the solvent is organic in that the alkali metal orthophosphates or the pyrophosphates are not particularly soluble therein. Settling out of the components can also be prevented by using mixtures of water and lower monohydric alcohols such as ethanol in a weight ratio of from about 4:1 to about 1:4 in the liquid applications of the present invention.

When liquid detergent compositions are intended the detergent component may be a minor amount of the overall composition or the detergent may be the solvent for the remainder of the components. In particular, ethoxylated alcohols having from 1 to 30 moles of ethylene or propylene oxide and an alkyl radical having a chain length of from about 8 to 16 carbon atoms are particularly suitable as liquid mediums for the detergent composition.

To either the additive product or the detergent composition of the present invention minor amounts on the order of from about 1 to 10% by weight of an electrolytic material, e.g., potassium chloride or sodium acetate may be added to assist in maintaining a suspension of the component in the solvent medium.

Semi-solid or pasty compositions of the present invention are formed much in the manner as the liquid compositions discussed above, however the amount of solvent used is held to the magnitude of about 10% to about 30% by weight or merely enough to give the composition a pasty consistency.

Solid products of the present invention are preferably in the form of laundry bars or granules having a moisture content generally less than about 12% by weight of the finished product.

Laundry bars of the present invention are most conveniently prepared by forming an aqueous slurry of the components and then dehydrating the slurry to the point where it becomes quite viscous and then applying pressure to the plastic mass sufficient to give it a nonmaleable character at room temperature. The process of forming laundry bars is described in U.S. Pat. No. 3,178,370 issued Apr. 13, 1965 and British Pat. No. 1,064,414 issued Apr. 5, 1967 each to Okenfuss both of which are incorporated by reference.

To form the granular additive or detergent composition of the present invention, the product may be converted into a solid by dehydrating the slurry with methods such as spray drying, drum drying, agglomeration, or freeze drying. Spray drying is a preferred method of preparing the detergent additive or detergent composition of the invention as the other stated methods of preparing the product in a solid form require an additional step of breaking up the large bulk of dried product into granules which are acceptable to consumer aesthetics.

When spray drying the product of the present invention, countercurrent and cocurrent drying towers may be employed. The preferred method and apparatus for spray-drying products of the present invention are described in U.S. Pat. Nos. 3,629,951 and 3,629,955, issued to R. P. Davis et al on Dec. 28, 1971, herein incorporated by reference. The granule so formed in either the additive or complete detergent product are free flowing of uniform density and not tacky.

COMPOSITION UTILIZATION

The additive products of the present invention will ordinarily be formulated for use in the wash or soak solution, preferably from about 0.05% to about 0.3% by weight of the wash or soak solution. Such product usage corresponds from about ⅛ of a cup to about 2 cups of liquid, and from about ¼ to about 1½ cups of the granular composition. Similarly the detergents of the present invention in either liquid or granular form are used at from about ⅛ of a cup to about 1½ cups. The liquid detergents of the present invention are particularly effective when applied directly to the water in the washer soaked solution. Washing temperatures are generally in the range of from about 70° F to about 130° F, and substantially higher under European washing conditions.

EXAMPLE I

A liquid detergent additive is prepared by thoroughly mixing:

| | |
|---|---|
| 3.3 % | Na orthophosphate |
| 6.7 % | silica (Ludox ® HS40 $14\times10^{-3}$ microns*) |
| 90 % | $H_2O$ (solvent) |

*Denotes in all Examples the mean particle diameter.

The additive product at a concentration of 0.08% by weight is used as a soak solution for one hour on Dacron Polyester fabric soiled with clay. A detergent having the following composition is used to wash the fabrics in a normal cycle in a commercial washer. The fabrics presoaked in the additive product and then washed are substantially cleaner than control swatches presoaked in water alone and then washed with the detergent described above.

| | |
|---|---|
| 25 % | $Na_2CO_3$ |
| 18 % | $C_{12}$ Alkyl benzene sulfonate |
| 18 % | Sodium Silicate ($Na_2O$:$SiO_2$ 1:1.6) |
| 30 % | $Na_2SO_4$ |
| 9 % | Minors to 100% |

The experiment is repeated using a mixture of ethanol and water in a 1:1 ratio as the solvent with similar results. The water may be replaced by a coconut cut triethoxylated alcohol to give a complete detergent product. This product used alone under the conditions of the example compares favorably to the previous compositions.

The water content is lowered to 10% of the composition and the remainder of the formula in a paste state contains sodium orthophosphate and the silica described above in a 25:1 weight ratio as another example of the present invention.

Example I is prepared as in the previous paragraph containing sodium pyrophosphate and sodium orthophosphate such that the total phosphate present is in a 25:1 weight ratio to the silica. The weight ratio of the pyrophosphate to the orthophosphate is 1.5:1. This variation is repeated with the pyrophosphate to orthophosphate weight ratio as 1:4.

EXAMPLE II

Detergent products A–I in % by weight are prepared by spray-drying:

| Component | A | B | C | D | E | F | G | H | I |
|---|---|---|---|---|---|---|---|---|---|
| Sodium orthophosphate | 35 | 25 | 10 | 35 | 25 | 10 | 5 | 60 | 20 |
| Sodium pyrophosphate | — | — | — | — | — | — | — | 15 | |
| Silica (Ludox AM $13\times10^{-3}$miccrons) | 15 | — | — | 15 | — | 10 | — | — | 15 |
| Silica (Ludox HS40) | — | 10 | — | — | 10 | — | 1.0 | 5 | — |
| Silica (Ludox SM30) | — | — | 40 | — | — | — | — | 5 | — |
| Sodium silicate $SiO_2$:$Na_2O$ (1.6) | — | — | — | 10 | — | — | — | — | — |
| Sodium silicate $SiO_2$:$Na_2O$ (2.4) | — | — | — | — | 10 | — | 1 | — | — |
| Sodium silicate $SiO_2$:$Na_2O$ (3.2) | — | — | — | — | — | 10 | — | 25 | — |
| $C_{12}$ LAS | 10 | | 24 | 10 | 7 | 10 | 50 | 1 | 10 |
| $C_{14-16}$ alkyl triethoxy sulfate | — | 10 | | 20 | 5 | — | — | — | — |
| Tallow alcohol sulfate | 10 | 23 | | | 5 | — | — | — | 10 |
| Sodium sulfate | 20 | 25 | 20 | 5 | 20 | 50 | 31 | — | 20 |
| Minors (water, perfume, brightners) | 10% | 7% | 6% | 5 | 18 | 10 | 12 | 4 | 10 |

Detergent Products A, B and C without silicate perform better than D, E, and F the difference being emphasized in that the less soluble (higher ratio) silicates are better than the lower ratio silicate where the performance of D>E>F. G and H are further illustrations of the present invention. I is a product which performs excellently in cleaning, hardness control, and whiteness maintenance.

The tests above are conducted on clay soil stained terry cloth and dacron polyester swatches using the product at 0.12% by weight at 100° F. The percent reflectance of the cleaned fabric is measured in Hunter Whiteness Units showing hardness control and cleaning ability.

The whiteness maintenance test is performed by washing clean terry cloth in a wash solution containing as soil 200 ppm air filter soil, 200 ppm clay and 100 ppm lipid. The terry cloth is measured before washing for its percent reflectance (by a Hunter Whiteness meter) and after each wash cycle to determine the pick up of suspended soils. The wash conditions start with 20° C water (18° hardness, 258 ppm $CaCO_3$) which is heated to 95° C in 75 minutes. Products formulated as in Example II perform better than similar products without the silica and orthophosphate.

EXAMPLE III

The following additive products are prepared by spray drying:

| | A | B | C | D |
|---|---|---|---|---|
| Sodium orthophosphate | 15 | 30 | 40 | 25 |
| Silica (Ludox ®HS40 $14\times10^{-3}$) microns) | — | — | — | 50 |
| Silica (Ludox ®TM $25\times10^{-3}$microns) | — | — | 30 | — |
| Silica (Ludox SM 30 $7\times10^{-3}$ microns) | 30 | — | — | — |
| Silica ($1\times10^{-4}$ microns) | 5 | — | — | — |
| Silica (20 microns) | | 40 | — | — |
| Sodium silicate ($SiO_2$:$Na_2O$ 1.6:1) | | 10 | — | — |
| Sodium silicate ($SiO_2$:$Na_2O$ 2.4:1) | | — | — | 20 |
| Sodium silicate ($SiO_2$:$Na_2O$ 3.2:1) | | — | 15 | — |
| Sodium carbonate | 30 | 15 | — | — |
| Moisture and minors | 20 | 5 | 15 | 5 |
| | 100 | 100 | 100 | 100 |

The additive products above are tested with commercially available products and in each case enhance the performance of the detergent.

EXAMPLE IV

Products A, B and C are prepared as follows:

| | A | B | C |
|---|---|---|---|
| Sodium tallow alcohol sulfate | 9.9% | 9.9% | 9.9% |
| Sodium alkyl (11.8)* benzene sulfonate | 8.1 | 8.1 | 8.1 |
| Silica (HS 40 Ludox$^{-}$14 $\times$ $10^{-3}$ microns) | 8.0 | 8.0 | 8.0 |
| Sodium sulfate | 39.6 | 39.6 | 39.6 |
| Sodium carbonate | 3.0 | 3.0 | 3.0 |
| Sodium orthphosphate | 26.2 | — | — |
| Sodium tripolyphosphate | — | 24.4 | 49.6 |

-continued

| | A | B | C |
|---|---|---|---|
| Minors to 100% | | | |

*(11.8) Denotes the mean alkyl chain length.

A, B, C, are used to clean clay soiled dacron polyester fabric swatches at a concentration of 0.12% by weight in 100° F. water. The hardness of the water is 9 grains (3:1 $Ca^{++}/Mg^{++}$). The results measured by a Hunter Whiteness Meter in Hunter Whiteness Units. The test is repeated using clean terry cloth to test whiteness maintenance over several cycles. Product A made according to the invention performs substantially better than product B at an equal phosphorus content and substantially equal to the tripolyphosphate Product C at twice the phosphorus level.

EXAMPLE V

Products D, E, and F are identical to A, B, and C of Example IV respectively but each of D, E and F has 3.2:1 $SiO_2$:$Na_2O$ added at 8% by weight. D, E and F are tested as in Example IV with similar results.

Product D again is better in removing clay soil from Dacon Polyester fabric then Product E. Product F at more than twice the phosphorous level performs better than D. The addition of the soluble silicates has not substantially diminished the relative performance of D over A (Example IV).

EXAMPLE VI

Products G and H have the following composition:

| | G | H |
|---|---|---|
| sodium alkyl ($C_{14}$ - $C_{16}$)* triethoxy sulfate | 5.5% | 5.5% |
| sodium alkyl ($C_{11.8}$) benzene sulfonate | 7.0 | 7.0 |
| sodium tallow alcohol sulfate | 5.5 | 5.5 |
| sodium orthophosphate | 26.2 | 26.2 |
| sodium sulfate | 39.6 | 39.6 |
| sodium carbonate | 3 | 3 |
| sodium silicate ($SiO_2$:$Na_2O$ 3.2:1) | 8 | 8 |
| silica (HS 40 LUDOX 14 × $10^{-3}$ micron) | 8 | — |
| minors to 100 | | |

*($C_{14}$ - $C_{16}$) indicates alkyl chain length.

Compositions G and H are tested as in Examples IV and V. The results are similar to Examples IV and V.

Product G containing silica of the present invention performs better in clay soil removal from Dacron Polyester fabrics than does Product H which contains silicate but no silica.

EXAMPLE VII

A laundry bar is prepared with the following composition

| | |
|---|---|
| 24% | alkyl benzene sulfonate ($C_{13}$ hard) |
| 30% | calcium carbonate |
| 12% | sodium orthophosphate |
| 20% | silica (Prepared as in MacDonald U.S. Pat. 3,708,428 supra) |
| 8% | sodium silicate $SiO_2$:$Na_2O$ 1.6:1) |
| 6% | minors |

What is claimed is:

1. A granular detergent composition consisting essentially of:
   (a) from about 5% to about 60% by weight of sodium or potassium orthophosphate as a precipitating builder;
   (b) from about 1% to about 40% by weight of silica having a mean particle diameter less than 20 microns; and
   (c) an organic detergent at from about 1% to about 50% by weight of the composition.

2. The detergent composition of claim 1 additionally containing an alkali metal pyrophosphate as a precipitating builder in a weight ratio to the orthophosphate of from about 1.5:1 to 1:4.

3. The composition of claim 2 wherein the alkali metal phosphates are the sodium salts.

4. The composition of claim 1 wherein the organic detergent is selected from the group consisting of anionic and nonionic detergents and mixtures thereof.

5. The detergent composition of claim 4 wherein the weight ratio of the alkali metal orthophosphate to the silica is from about 25:1 to about 1:2.

6. The detergent composition of claim 5 wherein the mean particle diameter of the silica is from about 1 × $10^{-4}$ micron to about 5 microns.

7. The composition of claim 6 wherein the alkali metal orthophosphate is present at from about 8% to about 40% and the silica is present at from about 3% to about 30% by weight.

8. The detergent composition of claim 7 wherein the mean particle diameter of the silica is from about 5 × $10^{-4}$ micron to about 0.1 micron.

9. The detergent composition of claim 7 wherein the detergent component is a nonionic selected from the group consisting of alkoxylated alcohols and alkoxylated alkyl phenols having from 8 to 20 carbon atoms in the alkyl radical and from 1 to 30 alkoxy units per alkyl radical and mixtures thereof.

10. The composition of claim 9 wherein the nonionic detergent is an ethoxylated alcohol wherein the alcohol residue has from 10 to 16 carbon atoms and from 1 to 10 moles of ethylene oxide per mole of alcohol residue.

11. The composition of claim 10 wherein the nonionic detergent is present at from about 5% to about 40% by weight.

12. The composition of claim 11 wherein the organic detergent is anionic.

13. The composition of claim 12 wherein the organic detergent is selected from the group consisting of the alkali metal, ammonium, or substituted ammonium, alkyl ether sulfates, alpha-sulfocarboxylates, alkylbenzene sulfonates, and alkyl sulfates, and mixtures thereof.

14. The composition of claim 13 wherein the anionic detergent is present at from about 5% to about 40% by weight.

15. The detergent composition of claim 14 additionally containing at from about 1% to about 25% by weight of an alkali metal silicate having an $SiO_2$:$M_2O$ weight ratio of about 1.6:1 to about 4:1 wherein M is selected from the group consisting of sodium and potassium and mixtures thereof.

16. The detergent composition of claim 15 wherein the alkali metal silicate is the sodium salt at a level of from about 3% to about 20% by weight in a weight ratio to the silica of from about 10:1 to about 1:10.

* * * * *

UNITED STATES PATENT AND TRADEMARK OFFICE

CERTIFICATE OF CORRECTION

PATENT NO. : 4,089,795

DATED : May 16, 1978

INVENTOR(S) : John Bailey, John Randell

It is certified that error appears in the above-identified patent and that said Letters Patent are hereby corrected as shown below:

Column 1, line 35 "siled" should be -- soiled --.

Column 2, line 51 "ae" should be -- are --.

Column 4, line 47, "$10^{-4}$" should be -- $10^{-3}$--.

Column 13, Example II, "Sodium pyprophosphate, Column H, 15" should be -- - --. Column I, should be -- 15 --.

Signed and Sealed this

*Twelfth* Day of *December 1978*

[SEAL]

*Attest:*

RUTH C. MASON
*Attesting Officer*

DONALD W. BANNER
*Commissioner of Patents and Trademarks*